US006550196B2

(12) United States Patent
Braybrook

(10) Patent No.: US 6,550,196 B2
(45) Date of Patent: Apr. 22, 2003

(54) APPARATUS FOR AND A METHOD OF ATTACHING ITEMS TO CURTAIN WALLING

(75) Inventor: Peter Braybrook, Gloucester (GB)

(73) Assignee: Levolux A.T. Limited, Gloucester (GB)

( * ) Notice: Subject to any disclaimer, the term of this patent is extended or adjusted under 35 U.S.C. 154(b) by 0 days.

(21) Appl. No.: 09/956,853

(22) Filed: Sep. 21, 2001

(65) Prior Publication Data

US 2002/0124499 A1 Sep. 12, 2002

(30) Foreign Application Priority Data

Mar. 9, 2001 (GB) ..... 0105818

(51) Int. Cl.[7] ..... E04B 2/88

(52) U.S. Cl. ..... 52/235; 52/232; 52/407.1; 52/464; 52/765; 52/717.01; 52/745.16

(58) Field of Search ..... 52/235, 232, 457.1, 52/464, 764, 717.01, 741.1, 745.16, 765

(56) References Cited

U.S. PATENT DOCUMENTS

| | | | | | |
|---|---|---|---|---|---|
| 3,866,374 | A | * | 2/1975 | Dallen | 52/208 |
| 3,978,629 | A | * | 9/1976 | Echols, Sr. | 52/395 |
| 4,251,964 | A | * | 2/1981 | Francis | 52/282 |
| 4,650,702 | A | * | 3/1987 | Whitmyer | 428/31 |
| 5,199,236 | A | * | 4/1993 | Allen | 52/235 |
| 5,245,808 | A | * | 9/1993 | Grunewald et al. | 52/235 |
| 5,490,358 | A | * | 2/1996 | Grunewald et al. | 52/235 |
| 5,603,789 | A | * | 2/1997 | Whitmyer | 156/108 |
| 6,141,923 | A | * | 11/2000 | Habicht et al. | 52/235 |

FOREIGN PATENT DOCUMENTS

| | | |
|---|---|---|
| DE | 296 07 770 U1 | 7/1996 |
| EP | 0 764 749 | 3/1997 |
| GB | 2 313 857 | 12/1997 |
| GB | 2 313 857 A | 12/1997 |
| GB | 2 346 391 | 8/2000 |
| GB | 2 346 391 A | 8/2000 |

* cited by examiner

*Primary Examiner*—Carl D. Friedman
*Assistant Examiner*—Yvonne M. Horten
(74) *Attorney, Agent, or Firm*—Young & Thompson

(57) ABSTRACT

Apparatus for attaching items such as solar shading to curtain walling mullions of the kind defined, comprises a bracket having a generally U-shaped formation at one end for fitting over the generally U-shaped formation of the glazing bar of a mullion, a substantially planar portion which, when the bracket is fixed to the mullion, projects forwardly of the glazing bar and in use between two adjacent glazing units and a seal locating formation projecting laterally of the substantially planar portion. The generally U-shaped formation comprises a web portion and two parallel or substantially parallel side portions. The web portion has an aperture therein above and/or below the substantially planar portion for receiving a self-tapping screw which can, in use, extend through the aperture and engage with the groove in the U-shaped formation of the glazing bar.

18 Claims, 2 Drawing Sheets

APPARATUS FOR AND A METHOD OF ATTACHING ITEMS TO CURTAIN WALLING

INTRODUCTION

This invention relates to apparatus for and a method of attaching items, particularly solar shading, to curtain walling and, more particularly, to a curtain walling mullion of the kind having an integral internal glazing bar extending longitudinally along the front face of the mullion, the glazing bar having first and second elongate formations on opposite sides of the glazing bar for receiving sealing elements and a central stem portion projecting forwardly midway between and spaced from the first and second formations, the stem portion having a generally U-shaped formation at its free end to define a groove for receiving self-tapping screws. Such a mullion will be referred to hereinafter as a mullion of the kind herein defined.

SUMMARY OF THE INVENTION

According to a first aspect of the invention, there is provided apparatus for attaching items such as solar shading to curtain wall mullions of the kind herein defined, the apparatus comprising a bracket having a generally U-shaped formation at one end for fitting over the generally U-shaped formation of the glazing bar of a mullion, a substantially planar portion which, when the bracket is fixed to the mullion, projects shading attached to curtain walling mullions by a method comprising the steps of:

(a) selecting apparatus for attaching solar shading to curtain wall mullions of the kind herein defined, the apparatus comprising:
- a bracket having a generally U-shaped formation at one end for fitting over the generally U-shaped formation of the glazing bar of a mullion,
- a substantially planar portion which, when the bracket is fixed to the mullion, projects forwardly of the glazing bar and in use between two adjacent glazing units, and
- a seal locating formation projecting laterally of the substantially planar portion, the generally U-shaped formation comprising a webportion and two parallel or substantially parallel side portions, the web portion having an aperture therein above and/or below the substantially planar portion for receiving a self-tapping screw which can, in use, extend through the aperture and engage with the groove in the U-shaped formation of the glazing bar, (b) push fitting the generally U-shaped formation of the bracket over the U-shaped formation at the free end of the stem of the glazing bar of the mullion,
- a seal locating formation projecting laterally of the substantially planar portion, the generally U-shaped formation comprising a webportion and two parallel or substantially parallel side portions, the web portion having an aperture therein above and/or below the substantially planar portion for receiving a self-tapping screw which can, in use, extend through the aperture and engage with the groove in the U-shaped formation of the glazing bar, (c) push fitting the generally U-shaped formation of the bracket over the U-shaped formation at the free end of the stem of the glazing bar of the mullion, (d) locating the self-tapping screw in the or at least one of the apertures in the web portion of the generally U-shaped formation of the bracket, and screw-threadably engaging the screw with the groove in the U-shaped formation of the glazing bar, and (e) connecting an item to the bracket.

A preferred feature of the second aspect of the invention is set forth below.

According to a third aspect of the present invention, there is provided solar forwardly of the glazing bar and in use between two adjacent glazing units and a seal locating formation projecting laterally of the substantially planar portion, the generally U-shaped formation comprising a web-portion and two parallel or substantially parallel side portions, the web portion having an aperture therein above and/or below the substantially planar portion for receiving a self-tapping screw which can, in use, extend through the aperture and engage with the groove in the U-shaped formation of the glazing bar.

Preferred and/or optional features of the first aspect of the invention are set forth below.

According to a second aspect of the present invention, there is provided a method of attaching items such as solar shading to curtain wall mullions of the kind herein defined, comprising the steps of:

(a) selecting apparatus for attaching items such as solar shading to curtain wall mullions of the kind herein defined, the apparatus comprising:
- a bracket having a generally U-shaped formation at one end for fitting over the generally U-shaped formation of the glazing bar of a mullion,
- a substantially planar portion which, when the bracket is fixed to the mullion, projects forwardly of the glazing bar and in use between two adjacent glazing units, and (b) locating the self-tapping screw in the or at least one of the apertures in the web portion of the generally U-shaped formation of the bracket, and screw-threadably engaging the screw with the groove in the U-shaped formation of the glazing bar, and (c) connecting an item to the bracket.

Preferred and/or optional features of the third aspect of the invention are set forth below.

The invention will now be more particularly described with reference to the accompanying drawings.

DESCRIPTION OF THE PREFERRED EMBODIMENT

Figure 1:
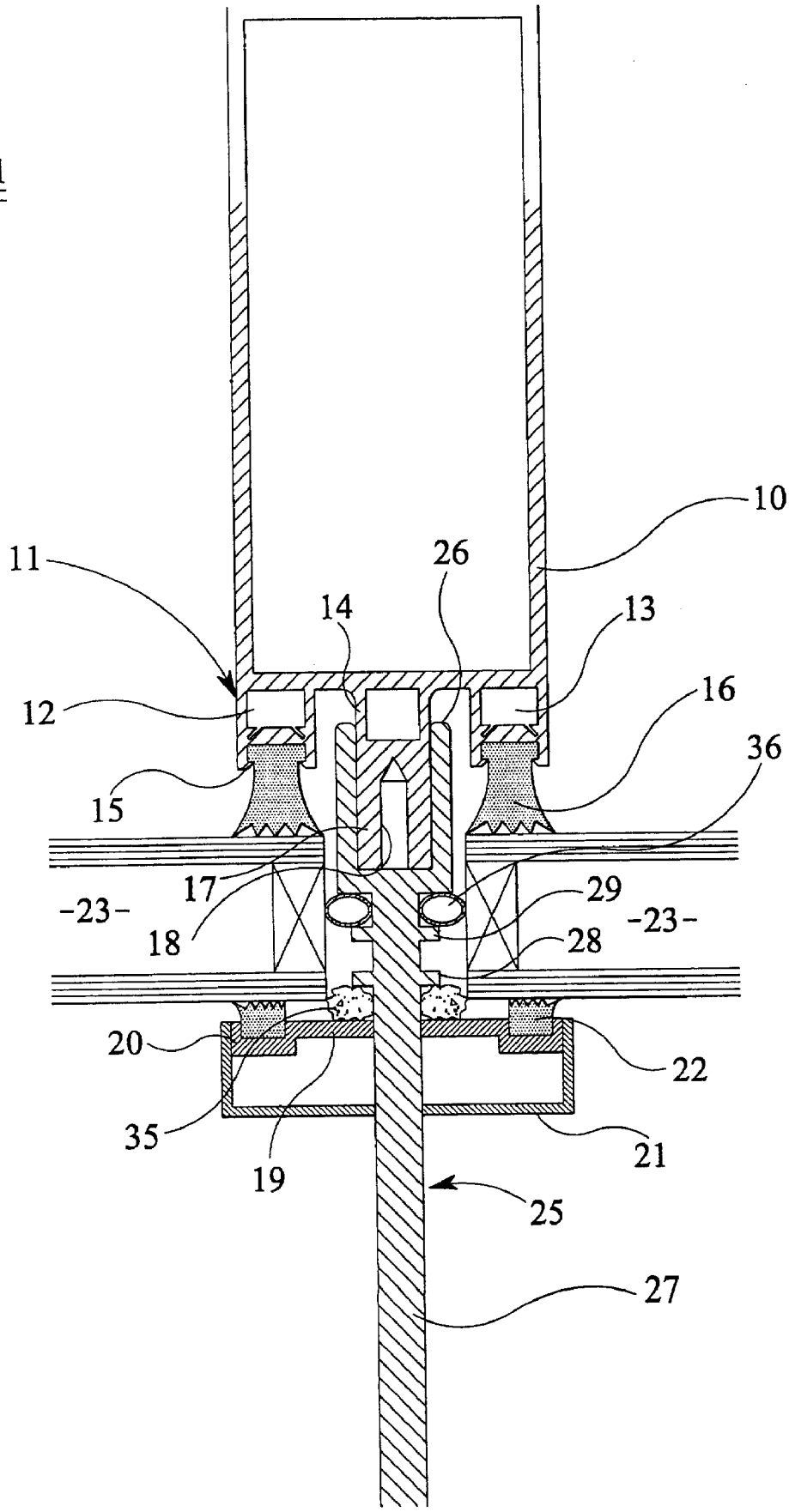
FIG. 1 is a horizontal section taken through a known curtain walling mullion and glazing assembly, together with one embodiment of apparatus according to the present invention.

Referring firstly to FIG. 1 of the drawings, the known curtain walling mullion and glazing assembly shown therein is of a type made by Schuco International KG and comprises a box section mullion 10 having an integral internal glazing bar 11 extending along the length of the front face of the mullion. The mullion 10 is extruded in aluminium.

The glazing bar 11 has two hollow, box section, ribs 12 and 13, one on each side of the glazing bar, and a central stem portion 14 projecting forwardly mid-way between the ribs 12 and 13. Each rib 12, 13, has on its front face a C-shaped formation 15, which supports an elongate sealing element 16.

The stem portion 14 has a U-shaped formation 17 at its free end. The formation 17 defines a serrated groove 18 which receives self-tapping screws.

The glazing assembly also comprises an external glazing bar 19 having two C-shaped formations 20 adjacent to each of two opposite edges of the glazing bar 19 and an elongate cap 21 which is snap fittable over the glazing bar 19. The formations 20 support two further elongate sealing elements 22.

Glazed units 23, which are typically double glazed panels, are held between the internal and external glazing bars 11 and 19 by self-tapping screws (not shown) which pass through apertures in the glazing bar 19 and engage in the groove 18 of the glazing bar 11. The elongate cap 21 conceals the heads of the screws.

Figure 2:
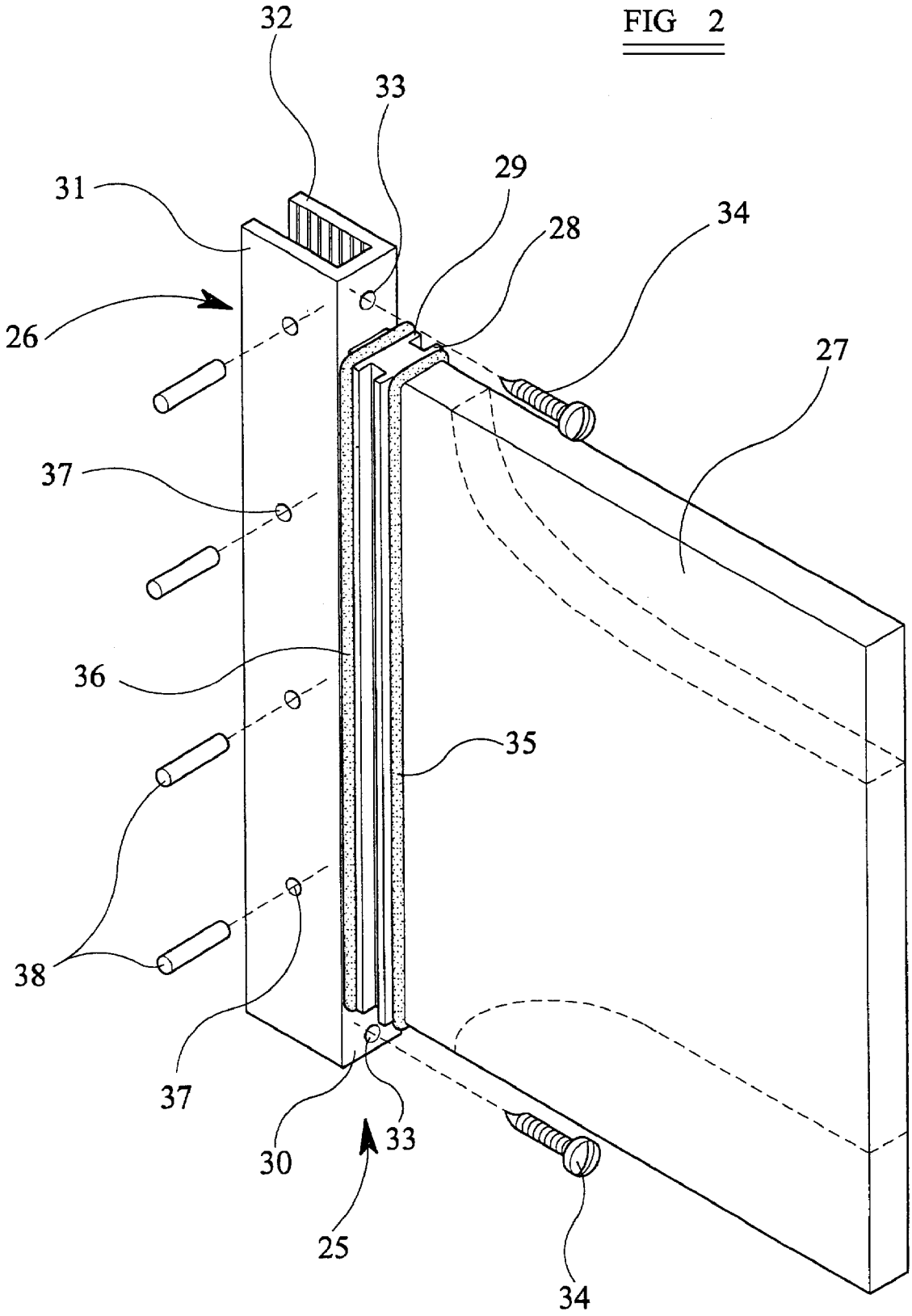
FIG 2 is a perspective view of the apparatus shown in FIG. 1.

Referring now to FIGS. 1 and 2, there is shown therein a bracket 25 (which may be formed by extrusion) having a generally U-shaped formation 26 at one end for fitting over the generally U-shaped formation 17 of the glazing bar 11. The bracket 25 also has a substantially planar portion 27 which, when the bracket 25 is fixed to the mullion, projects forwardly of the glazing bar 11 and between the two adjacent glazed units 23. The planar portion 27 has two seal locating formations 28 and 29. Each seal locating formation 28, 29 comprises ribs extending from opposite sides of the planar portion 27.

The generally U-shaped formation 26 comprises a web portion 30 and two parallel or substantially parallel side portions 31 and 32. The web portion 30 has an aperture 33 both above and below the planar portion 27 which terminates short of the upper and lower edges of the web portion 30. Each aperture 33 is arranged to receive a self-tapping screw 34 which can extend through the aperture 33 and engage with the groove 18 in the U-shaped formation 17 of the glazing bar 11.

The bracket is provided with two seals 35 and 36. Each seal 35, 36 is endless and surrounds the planar portion 27 of the bracket. The seal 35 is located against the seal locating formation 28 or against a spacer (not shown) provided between the seal locating formation 28 and the seal 35. The seal 36 is located between the seal locating formation 29 and the web;portion 30 of the generally U-shaped formation 26. The spacer referred to above may be required when the glazed units are thicker than those shown.

The seal 35 is a rain seal intended to prevent water ingress between the glazed units 23. The seal 36 is of hollow construction and provides a thermal break between the inside and outside of the glazing. It also serves as a soft cushion against which the glazed units 23 can lie.

The side portions 31 and 32 of the generally U-shaped formation 26 are each provided with a plurality of apertures (as shown four) 37 which are aligned with corresponding apertures 37 in the other side portion for a purpose which will be explained hereinafter.

The planar portion 27 of the bracket 25 can be profiled, as required. For example, it could be profiled as shown by the broken lines in FIG. 2.

The bracket 25 is attached to the curtain walling mullion in the following manner. The U-shaped formation 26 of the bracket 25 is pushed over the U-shaped formation 17 of the internal glazing bar 11. Self-tapping screws 34 are then inserted into the apertures 33 and screw-threadably engaged with the groove 18 of the U-shaped formation 17 of the glazing bar 11. A drill is then used to form apertures in the stem 14 of the internal glazing bar 11, which apertures are aligned with the apertures 37. Pins 38 (see FIG. 2) are then pushed through the apertures 37 and the apertures in the stem 14. The external glazing bar 19 and cap 21 are fitted. A mastic seal may be applied between the cap 21 and the bracket 25 to prevent ingress of water.

The seals 35 and 36 may be pre-fitted although seal 35 could be located on site.

Similar brackets 25 are secured to adjacent mullions and solar shading is then attached to the brackets.

The brackets 25 may be used to support any appropriate form of solar shading including, but not limited to, louvre constructions, roller blinds or awnings. It could also be used to support other items such as lights or signs.

The brackets 25 can be fitted during construction of curtain walling or may be retro fitted to existing constructions without any factory preparation.

There may be only one aperture 33, although in this case, it is preferably provided in the web portion 30 above the planar portion 27.

In certain circumstances, the seal 36 may be omitted.

Also, when connecting lightweight items to the brackets, it may be possible to do away with the pins 38 and in this case, it will not be necessary to drill apertures in the stem 14.

The embodiments described above are given by way of example only and various modifications will be apparent to persons skilled in the art without departing from the scope of the invention as defined in the appending claims.

What is claimed is:

1. Apparatus for attaching an item to a curtain wall mullion, the apparatus comprising:

a bracket having a generally U-shaped formation at one end for fitting over a generally U-shaped formation of a glazing bar of a mullion, a substantially planar portion which, when the bracket is fixed to the mullion, projects forwardly of the glazing bar and in use between two adjacent glazing units, and a seal locating formation projecting laterally of the substantially planar portion, the generally U-shaped formation comprising a web-portion and two parallel or substantially parallel side portions, the web portion having at least one aperture therein for receiving a screw which can, in use, extend through the aperture and engage with the groove in the U-shaped formation of the glazing bar.

2. Apparatus as claimed in claim 1, wherein the web portion has an aperture above and below the substantially planar portion for receiving self-tapping screws.

3. Apparatus as claimed in claim 1, wherein each side portion has one or more apertures aligned with a corresponding aperture or apertures in the other side portion to receive pins which, in use, also extend through apertures in the stem portion of the glazing bar.

4. Apparatus as claimed in claim 1, wherein the seal locating formation comprises ribs extending from opposite sides of the substantially planar portion.

5. Apparatus as claimed in claim 1, further comprising a seal located against the seal locating formation or against a spacer interposed between the seal locating formation and the seal.

6. Apparatus as claimed in claim 5, wherein the seal is endless and surrounds the substantially planar portion.

7. Apparatus as claimed in claim 1, further comprising a further seal locating formation between the first-mentioned seal locating formation and the web portion of the generally U-shaped formation.

8. Apparatus as claimed in claim 7, wherein the further seal locating formation comprises ribs extending from opposite sides of the substantially planar portion.

9. Apparatus as claimed in claim 7, further comprising a further seal located between the web portion of the generally U-shaped formation and the further seal locating formation.

10. Apparatus as claimed in claim 9, wherein the further seal is endless and surrounds the substantially planar portion.

11. Apparatus as claimed in claim 1, wherein the item comprises a solar shading.

12. A method of attaching items such as solar shading to curtain wall mullions of the kind herein defined, comprising the steps of:

(a) selecting apparatus for attaching items such as solar shading to curtain wall mullions of the kind herein defined, the apparatus comprising:

a bracket having a generally U-shaped formation at one end for fitting over the generally U-shaped formation of the glazing bar of a mullion, a substantially planar portion which, when the bracket is fixed to the mullion, projects forwardly of the glazing bar and in use between two adjacent glazing units, and a seal locating formation projecting laterally of the substantially planar portion, the generally U-shaped formation comprising a web-portion and two parallel or substantially parallel side portions, the web portion having an aperture therein above and/or below the substantially planar portion for receiving a self-tapping screw which can, in use, extend through the aperture and engage with the groove in the U-shaped formation of the glazing bar, (b) push fitting the generally U-shaped formation of the bracket over the U-shaped formation at the free end of the stem of the glazing bar of the mullion, (c) locating the self-tapping screw in the or at least one of the apertures in the web portion of the generally U-shaped formation of the bracket, and screw-threadably engaging the screw with the groove in the U-shaped formation of the glazing bar, and (d) connecting an item to the bracket.

13. A method as claimed in claim 12, wherein each side portion of the apparatus has one or more apertures aligned with a corresponding aperture or apertures in the other side portion to receive pins which, in use, also extend through apertures in the stem portion of the glazing bar and the method further comprises, prior to step (d), the step of drilling at least one aperture in the stem portion of the glazing bar to be aligned with a pair of the apertures of the side portions and inserting a pin through the apertures in the side portions of the U-shaped formation of the bracket and in the stem portion of the glazing bar.

14. Solar shading attached to curtain walling mullions by a method comprising the steps of:

(a) selecting apparatus for attaching solar shading to curtain wall mullions of wall mullions of the kind herein defined, the apparatus comprising:

a bracket having a generally U-shaped formation at one end for fitting over the generally U-shaped formation of the glazing bar of a mullion, a substantially planar portion which, when the bracket is fixed to the mullion, projects forwardly of the glazing bar and in use between two adjacent glazing units, and a seal locating formation projecting laterally of the substantially planar portion, the generally U-shaped formation comprising a web-portion and two parallel or substantially parallel side portions, the web portion having an aperture therein above and/or below the substantially planar portion for receiving a self-tapping screw which can, in use, extend through the aperture and engage with the groove in the U-shaped formation of the glazing bar, (b) push fitting the generally U-shaped formation of the bracket over the U-shaped formation at the free end of the stem of the glazing bar of the mullion, (c) locating the self-tapping screw in the or at least one of the apertures in the web portion of the generally U-shaped formation of the bracket, and screw-threadably engaging the screw with the groove in the U-shaped formation of the glazing bar, and (d) connecting an item to the bracket.

15. Solar shading as claimed in claim 14, wherein each side portion of the apparatus has one or more apertures aligned with a corresponding aperture or apertures in the other side portion to receive pins which, in use, also extend through apertures in the stem portion of the glazing bar and the method further comprises, prior to step (d), the step of drilling at least one aperture in the stem portion of the glazing bar to be aligned with a pair of the apertures of the side portions and inserting a pin through the apertures in the side portions of the U-shaped formation of the bracket and in the stem portion of the glazing bar.

16. Solar shading as claimed in claim 14, in the form of louvre constructions.

17. Solar shading as claimed in claim 14, in the form of roller blinds.

18. Solar shading as claimed in claim 14, in the form of awnings.

* * * * *